US005535804A

United States Patent [19]

Guest

[11] Patent Number: 5,535,804

[45] Date of Patent: Jul. 16, 1996

[54] PET DOOR KIT

[76] Inventor: Robert J. Guest, 34 Forest Street, Aylmer, Quebec, Canada, J9H 4E6

[21] Appl. No.: 318,434

[22] Filed: Oct. 5, 1994

[51] Int. Cl.[6] ..... E06B 7/28

[52] U.S. Cl. ..... 160/180; 160/380; 160/DIG. 8

[58] Field of Search ..... 160/180, 116, 160/DIG. 8, 380, 381, 89, 237; 49/169, 170, 171

[56] References Cited

U.S. PATENT DOCUMENTS

| | | | |
|---|---|---|---|
| 3,690,299 | 9/1972 | Johnson | 49/169 X |
| 4,334,573 | 6/1982 | Hackman et al. | 160/180 |
| 4,603,724 | 8/1986 | Bornick | 160/180 |
| 4,651,793 | 3/1987 | Davlantes | 49/169 X |
| 5,117,890 | 6/1992 | Taylor et al. | 160/180 |

*Primary Examiner*—Blair M. Johnson
*Attorney, Agent, or Firm*—Thomas Adams & Assoc.

[57] ABSTRACT

A pet door kit made of frame sides and door sides all of which may be assembled onto a mesh screen panel before the panel is required to be cut to allow for pivoting of the door. Advantageously each frame side is formed as an integral molding with an associated door side so that the skill of the installer is not required to locate the door within the frame. Economically, the two moldings thus provided are identical and securing members, i.e. pins are integrally provided to pass from one molding, through the mesh, and be force fitted into holes in the other molding. The assembly of the two moldings simultaneously and quickly assembles the door and frame onto the firm unsevered rigid support of the screen panel.

19 Claims, 4 Drawing Sheets

PET DOOR KIT

This invention relates to pet door kits.

Pet doors are known which fit into mesh screen panels of house doors and are normally hinged about horizontal axes along tops of the pet doors. A pet door, when hinged in this manner, enables pets to enter or leave a house by pushing on the pet door which swings in the appropriate direction relative to the screen to open the door which normally hangs in a vertical closed condition under the influence of its own weight and/or by resiliency provided along the hinge position.

Known pet doors suffer from various problems which mainly relate to the methods of assembly. For instance, in U.S. Pat. No. 4,603,724, a pet door is described which requires door frame parts to be located in opposed locations on each side of the screen panel, the frame parts necessarily inter-fitting to secure the frame parts to the screen panel. The inter-fitting of the frame parts causes distortion of the screen panel by forcing it out of its normal, planar condition. The part of the screen panel lying within the boundary of the door frame is then in a stretched and distorted condition and it is necessary to cut out and scrap this part of the screen panel to provide a pet door opening. The door also has door parts which are disposed one on each side of an additional area of screen panel, these parts also being secured together in inter-fitting manner which distorts this additional screen panel area. The door and frame are difficult to assemble and resistance to assembly is offered by the screen panel after its distortion commences. Certainly this difficulty is pronounced by the fact that the pet door needs to be assembled into a screen panel which is already vertically positioned towards the bottom of the house screen panel door.

The present invention seeks to provide a pet door kit which, during assembly into a door and frame, minimizes the above problems. The invention also provides a method of assembly of a pet door and frame which also minimizes the problems.

Accordingly the present invention provides a pet door kit comprising a door frame having two frame sides, a door comprising two door sides, the frame sides for mounting in opposition one on each side of a mesh screen panel and the door sides for mounting in opposition one on each side of the screen panel and pivotable through an aperture defined within the frame, and a first group of securing members and a second group of securing members for passing through the screen panel with the members of the first and second groups in spaced localized positions, respectively, around the door frame and around the door to secure the frame sides together and to secure the door sides together while sandwiching the screen panel between the sides of the frame and between the sides of the door, and in assembled condition of the kit, access being provided to enable the screen panel to be severed around the door to permit the door to pivot within the frame.

The pet door kit of the invention enables the sides to be assembled together by passing of the securing members through the screen panel and therefore distortion of the screen panel for gripping purposes is avoided. Securing members make direct contact with the door and frame sides on the other side of the screen panel for connection purposes. It is a practical method of assembly for the securing members not only to pass through but also to pierce the screen panel, the spaced localized positions registering the door frame and the door in the desired position upon the screen panel. While the frame sides and the door sides are assembled together to sandwich the screen panel, sandwich pressure need only be minimal and even if some localized distortion occurs in the screen panel this may be insignificant and allows both the frame and the door to be assembled upon the screen panel before the screen panel is cut to allow for pivoting of the door. Hence the door is located in its operating position within the frame and upon the screen panel which operates as a substantially firm body to allow for such assembly.

In a preferred construction, the sides of the door frame and the sides of the door have screen panel engaging surfaces all of which are planar. With such an arrangement the screen panel is maintained in its plane during assembly of the door kit onto the screen panel so that no distortion of the screen panel will take place.

In a practical arrangement, the kit comprises two molded parts with each molded part comprising a frame side and an associated door side together with an integral hinge portion by which the door side is pivotable upon the frame side. With such an arrangement the two door sides are correctly positioned within the frame sides during manufacture of the molded parts thus minimizing the assembly skills required by the installer. Alternatively, the door sides are separate from the frame sides and need to be assembled upon the screen panel in a separate manner. With this arrangement, in assembled condition, the door may be completely separate from the frame except for an unsevered part of the screen panel extending between door and frame along one side of the door, the screen panel thus acting as the hinge for the door.

With the two molded parts as mentioned above, it is convenient for at least one of the frame sides to be formed integrally with securing members of the first group and at least one of the door sides to be formed integrally with securing members of the second group, apertures being formed in the other door and other frame sides for receiving the securing members. In a further preferred arrangement, the two molded parts of the door kit are identical with each molded part integrally formed with securing members of each of the first and second groups and also being formed with apertures for receiving securing members of the first and second groups which extend from the other molded part. It is also to be preferred that the securing members are a force fit within their corresponding apertures so that the door kit may be assembled merely by applying pressure from each side of the screen panel to force the securing members into the apertures. Alternatively the securing members pass into apertures which allow for a sliding fit. In such a case, it is necessary for screws to be mounted into the free ends of the securing members to prevent their removal from within the apertures and hold the assembly together.

The invention also includes a method of assembling a pet door and frame onto a mesh screen panel comprising disposing two sides of a door frame in opposition one on each side of the screen panel and two sides of a door in opposition one on each side of the screen panel and securing the opposed sides together with the screen panel sandwiched between them by passing through the screen panel in spaced localized positions, a first group of securing members to secure the frame sides together to form the frame and a second group of securing members to secure the door sides together to form the door; and then through an access provided between the door and the frame, severing the screen panel around the door to permit the door to pivot within the frame.

The invention further includes a pet door and mesh screen panel combination comprising a pet door having a frame comprising two frame sides mounted in opposition one of each side of the screen panel with a first group of securing members extending in spaced localized positions through the screen panel and securing the frame sides together with the screen panel sandwiched between them and a door comprising two door sides mounted in opposition one on each side of the screen panel with a second group of securing members extending in spaced localized positions through the screen panel and securing the door sides together with the screen panel sandwiched between them, the door being pivotable through an aperture defined by the frame in the screen panel.

One embodiment of the invention will now be described, by way of example, with reference to the accompanying drawings, in which:

FIG. 1 is an exploded isometric view of a pet door kit according to the embodiment;

FIG. 2 to a smaller scale than FIG. 1, is a front view of the pet door kit at one stage of its assembly onto the mesh screen panel of a house door;

FIG. 3, to a larger scale than FIG. 1, is a cross sectional view through the pet door taken along line 111—111 of FIG. 2 and at the stage of assembly of FIG. 2;

Figure 1:
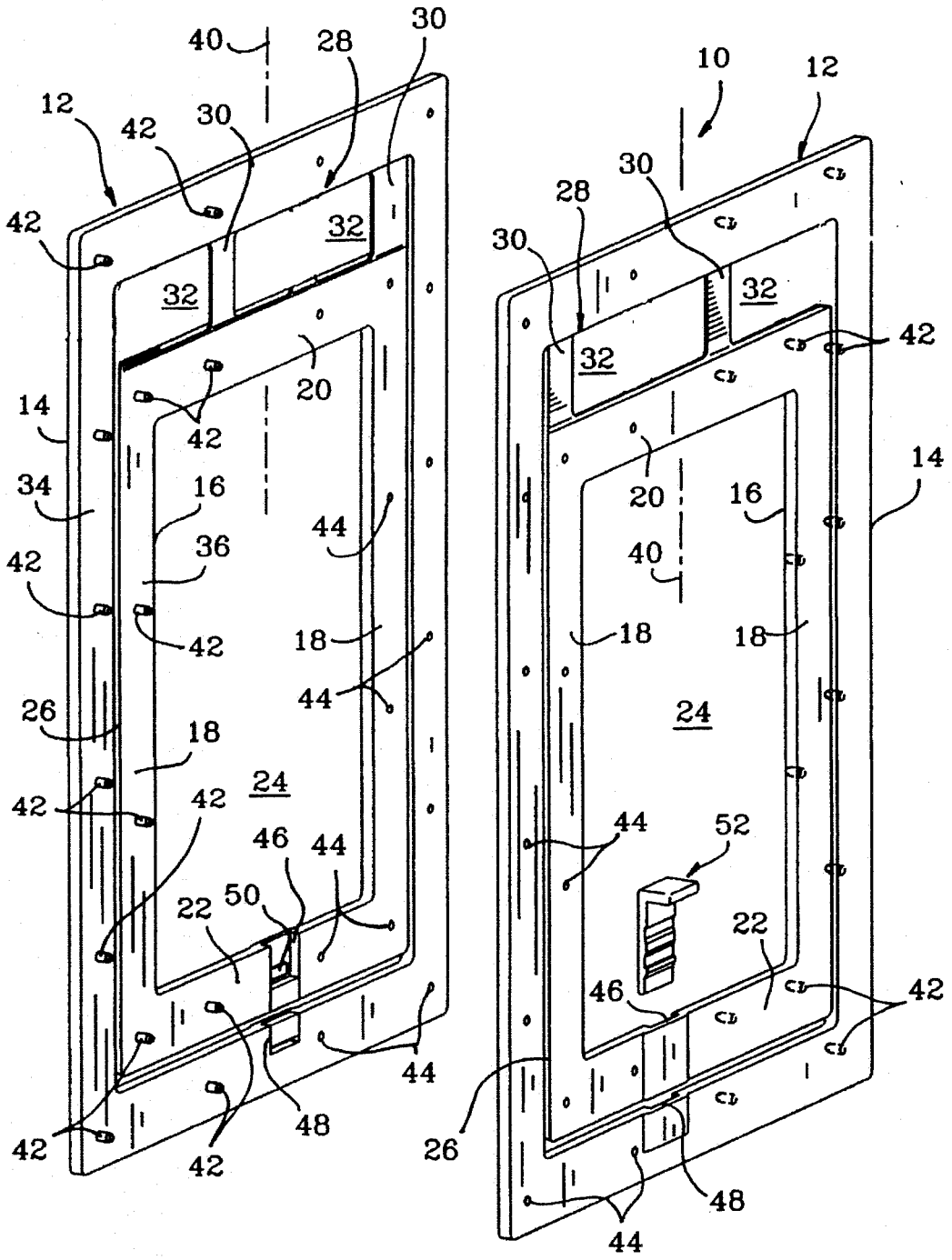

As shown by FIG. 1, a pet door kit 10 comprises two identical molded parts 12 each comprising a rectangular door frame side 14 and a rectangular door side 16. Each door side 16 has two long edge strips 18 and upper and lower edge strips 20 and 22, respectively, the edge strips defining a rectangular opening 24 within the door side. In each molded part, the door side 16 and the door frame side 14 lie in coplanar positions in their molded state with the door side 16 spaced from the door frame 14 by a molded slot 26 which extends alongside the long edge strips 18 and the short edge strip 22. The upper edge strip 20 of the door side is connected by an integral hinge structure 28 which integrally combines the door frame side and the door side together and forms a portion of a hinge as will be described. Each door side 16 is pivotable upon the associated door frame side 14 by the hinge structure 28 which is suitably molded for that purpose. As shown, the hinge structure 28 is formed of two parallel webs 30 defining spaces 32 therebetween, the webs 30 being molded thinner than the frame and door sides 14 and 16. This is clear from the depressions formed by the webs 30 in the molded part 12 at the right hand side of FIG. 1.

In addition, each of the molded parts 12 in its molded condition provides on one of its sides, screen panel engaging surfaces 34 and 36 of the frame side 14 and door side 16 which are planar (see left hand molded part 12 in FIG. 1). The corresponding sides of the webs 32 are also planar and are coplanar together with the surfaces 34 and 36.

The two molded parts 12 are identical. Each molded part 12 is formed on one side of a vertical center line 40 with elongate securing members in the form of pins 42. Thus as shown in FIG. 1 the left hand molded part has a group 42 of pins extending from the frame side 14 on the left of center line 40 together with a group of the pins 42 extending from the door side 16. These pins extend outwardly from the coplanar surfaces 34 and 36. Also shown in FIG. 1 the right hand molded part 12 has its pins 42 on the right of its center line 40. In each of the molded parts 12, through bores 44 are molded into the door and frame sides for the force fit acceptance of the pins 42 on the other molded part 12.

Figure 7:
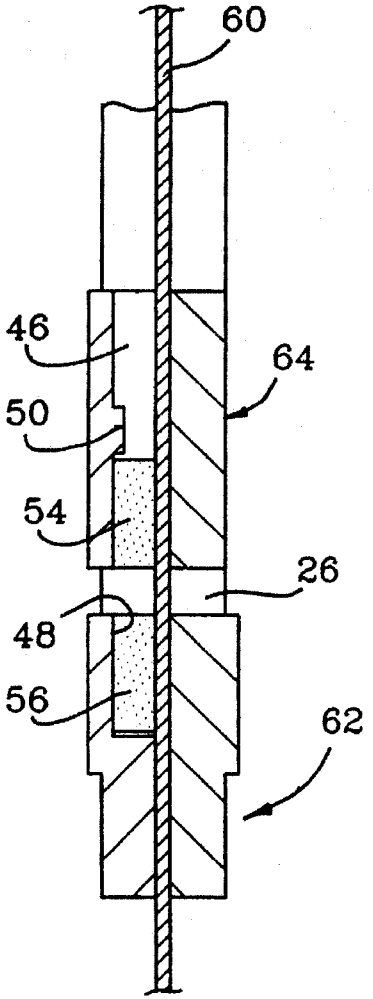
FIG. 7 is a cross sectional view of the pet door taken along line VII—VII in FIG. 4 and to the larger scale.
Figure 6:
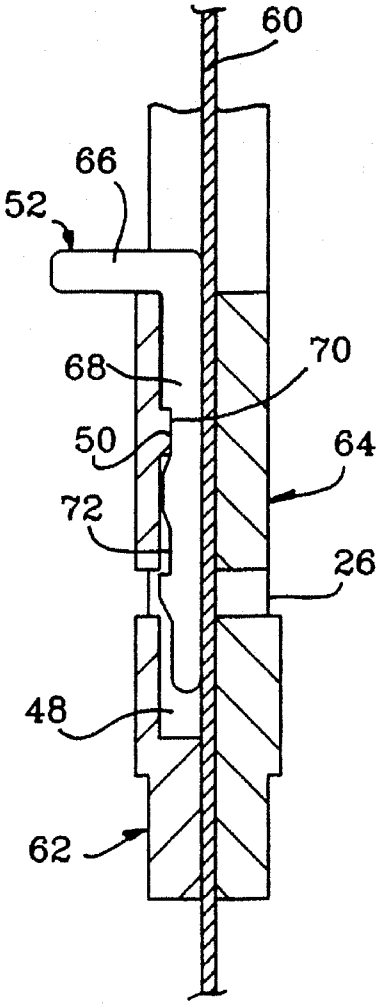
FIG. 6 is a view similar to FIG. 5 and showing the features of the door in different relative positions.
Figure 5:
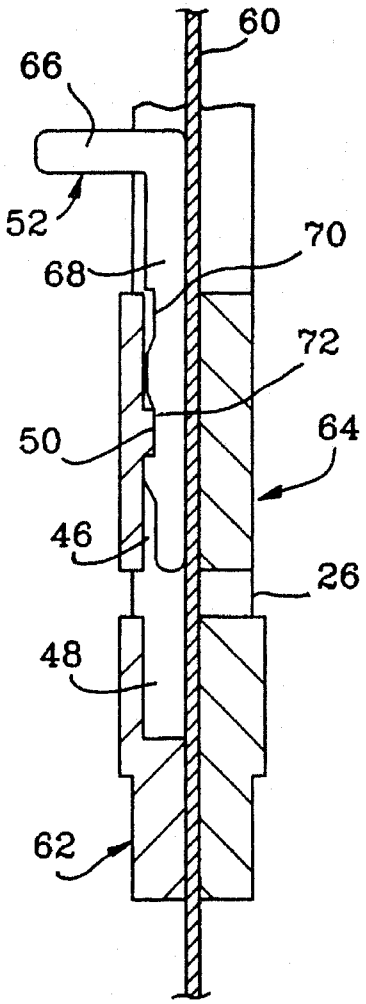
FIG. 5 is a cross-sectional view, to the scale of FIG. 3, through part of the pet door and taken along line V—V in FIG. 4.

Each of the molded parts 12 is also formed with a groove 46 formed in the surface 36 of the lower edge strip 32 and extending downwardly for the width of the strip. This groove 46 is in alignment with a corresponding groove 48 which extends a short distance from the slot 26 down into the frame part 14. Grooves 46 and 48 are disposed slightly to one side of the center line 40 as shown. Shown in greater detail in FIGS. 5, 6 and 7, each of the grooves 46 in the door sides 16 are is with a narrow lateral rib 50 which projects into the groove. As shown by FIGS. 5 and 6, in the case of the right hand molded part 12 of FIG. 1, the rib 50 is to be used to form a location for a latch 52 as will be described below. In the case of the left hand molded part 12, however, the rib 50 is used as an abutment for magnetic means which is used to align the door and the frame, with the door closed, so as to normally hold the door in the closed position until an opening force is applied to it. As may be seen from FIGS. 1 and 7, the magnetic means comprises a small block magnet 54 located in the groove 46 of the left hand molded part 12 and a corresponding block magnet 56 in the groove 48. The magnets 54 and 56 bottom, respectively, against the one side of the rib 50 and the bottom of the groove 48 to retain the magnets correctly in position.

Figure 2:
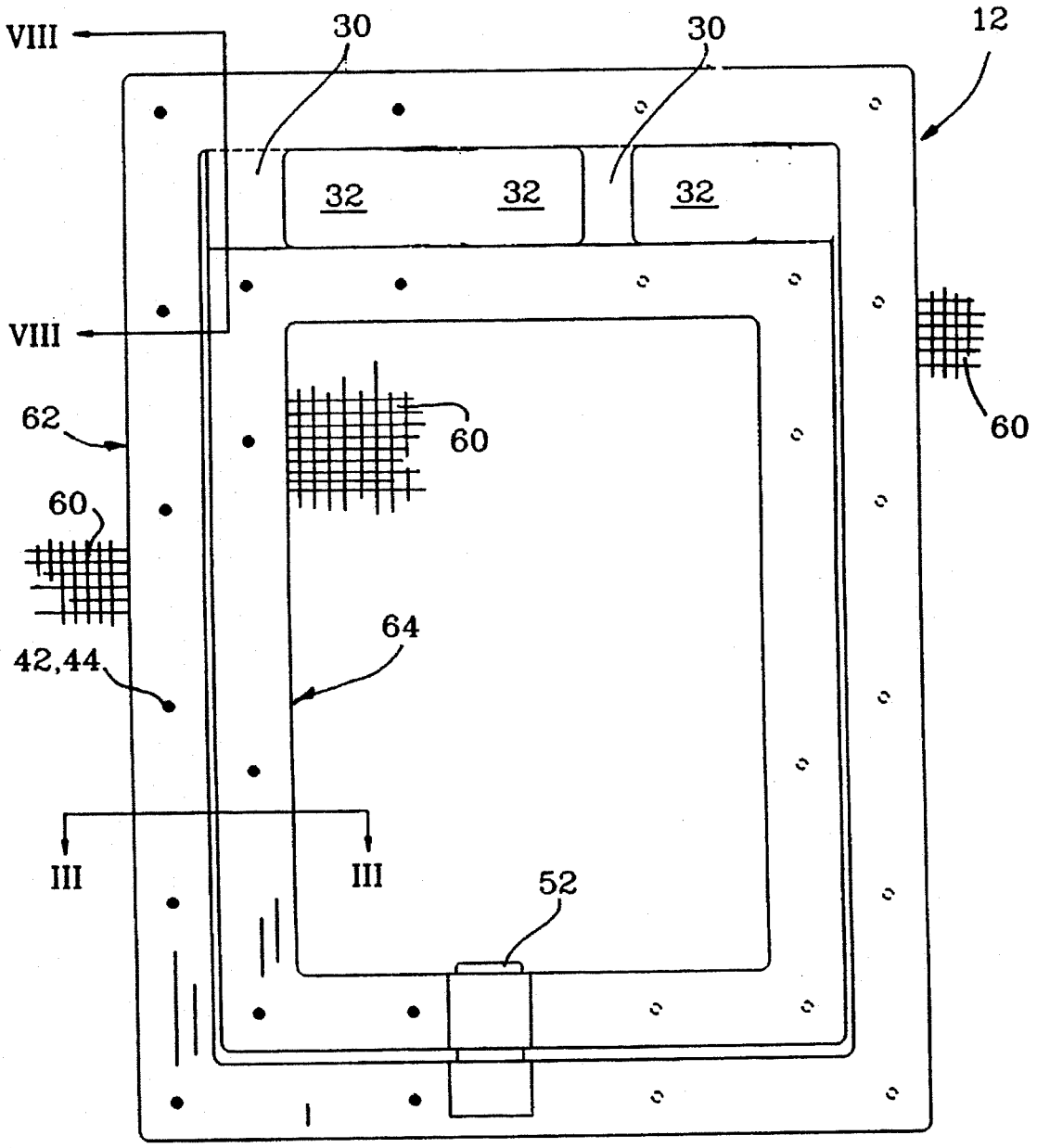
Figure 3:
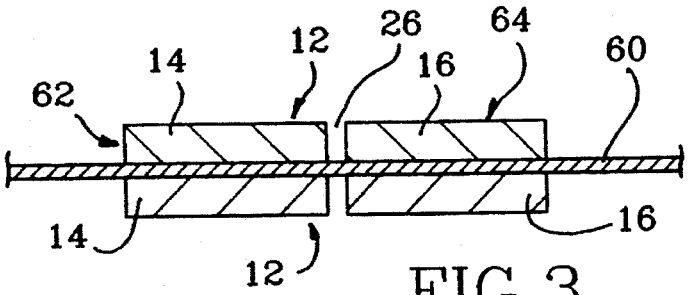

To assemble the pet door kit through a mesh screen panel 60 of a house door, with the screen panel 60 in its mounted vertical position in the house door, the two molded parts 12 are aligned with one another on opposite sides of the screen panel as shown in FIGS. 2 and 3. Pressure is then exerted to force the parts 12 towards each other so that the pins 42 of each part 12 pierce and pass through the mesh of the screen panel 60 and enter into corresponding bores 44 in the opposite molded part. Manual pressure then continues until the two molded parts sandwich and compress the screen panel 60 between them. The molded parts 12 are thus automatically aligned through the screen panel 60 with the door frame sides 14 assembled together to form a completed frame 62 (FIG. 2) and the door sides 16 combining to form a completed door 64. During the assembly process, the parts 12 are easily assembled into their correct relative positions with the rigidity of the screen panel assisting in this process and the hinge structures 28 controlling the position of the completed door 64 within the frame 62. Because of the planar surfaces 34 and 36, during the assembly of the two molded parts 12 onto the screen panel 60, the screen panel 60 is not distorted out of its original plane and no twisting of the screen panel can result and which could make assembly of the parts difficult. As shown in FIG. 3, for instance, when the molded parts 12 are positioned on the screen panel 60, the screen panel merely extends between the parts and is compressively sandwiched therebetween with the pins extending through the screen panel and into the bores 44 as discussed above.

After the molded parts are assembled onto the screen panel 60, to free the door 64 to enable it to pivot to either side of the screen panel, the screen panel is severed along the extent of the slot 26, i.e. around three sides of the door 64, while the screen panel at the third side, i.e. that extending between the hinge structure 28, continues between the door and the frame. Hence the hinge is formed by the hinge structures 28 and the screen panel between them.

Figure 4:
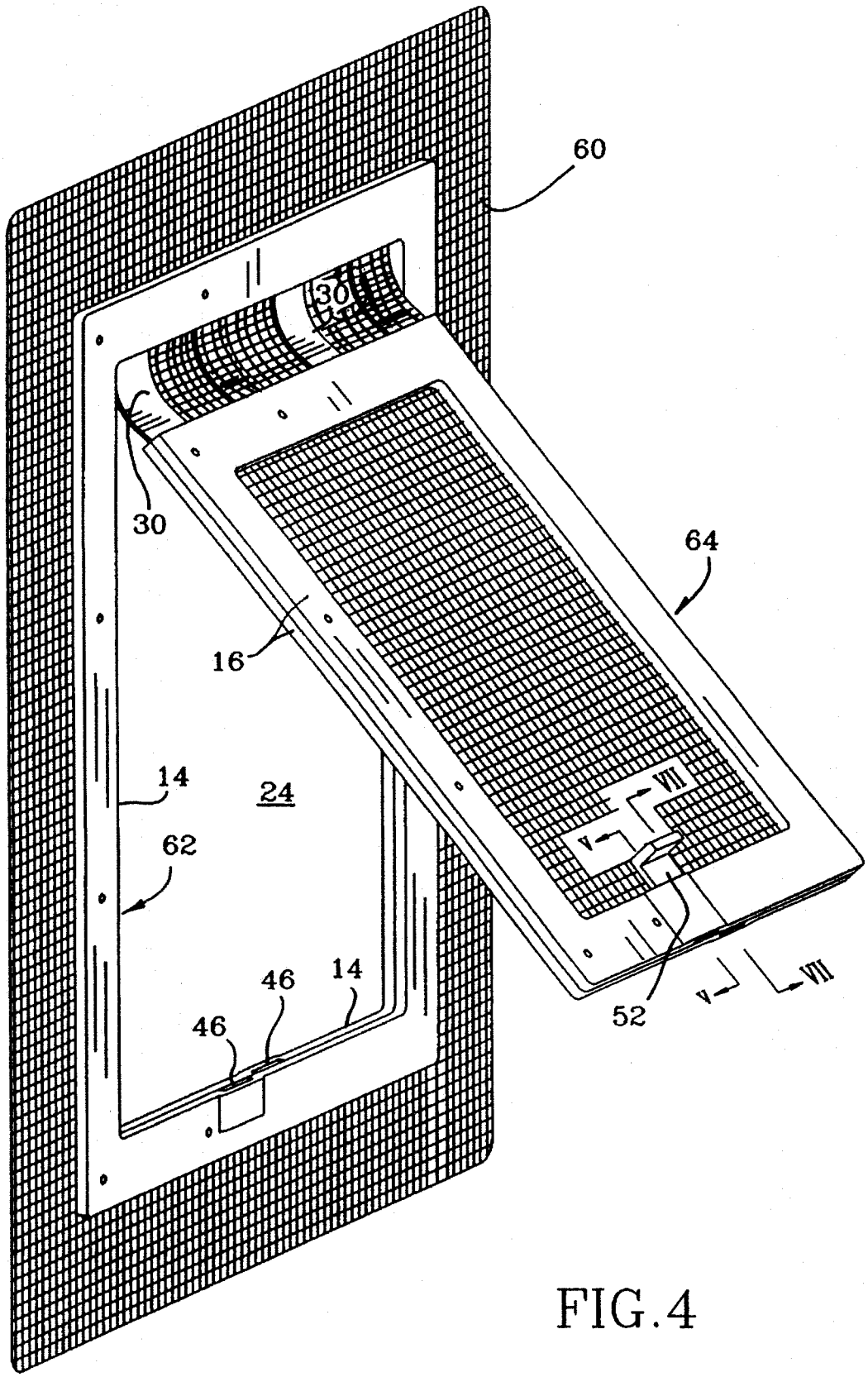
FIG. 4 is an isometric view, in the same direction as FIG. 1, showing the pet door after completion of assembly into the screen panel.

After cutting of the screen panel around the slot 26, the door 64 is free to move as shown in FIG. 4 in the complete assembly, from side to side of the door frame 62. As will be seen from FIG. 1, the two webs 30 of each part 12 are unsymmetrically placed with regard to the center line 40, the location of the webs being such that in the assembled condition of the door 64, the webs of each part 12 are completely non-aligned with the webs of the other part. This provides freedom for each part 12 to pivot independently while minimising any tendency for the webs to distort and bind.

As may be seen from the above description, the door and frame are easily assembled into the screen panel and the use of two molded parts 12 each having a part of the door assembled to part of the frame ensures correct location of the door in the frame without any required skill of the installer. Installation of the pet door is an easy and simple procedure which requires only one cutting operation, i.e. that to separate the completed door from the completed frame after installation in the screen panel. In addition to this, the fact that the two molded parts are identical makes the parts extremely simple and economic to manufacture. Also, as is noticeable, the pet door is assembled in one operation with frame and door being assembled simultaneously. Further, no cutting of the screen panel is performed until after assembly of the door and frame has been completed. It should be noted in this respect, that immediately after the assembly stage, the screen panel extends from the frame to door across the slot 26 as may be seen from FIG. 3.

In addition, although the parts are identical, the location of the grooves 46 and 48 to one side of the center line 40 of each molded part 12 ensures that the grooves can be used for two separate purposes, i.e. for the location of the magnetic means 54 and 56 in the one situation and for the location of the latch 52 in the other situation. As shown by FIG. 5, latch 52 is L-shaped, having a short projection 66 at its upper end for manual operation and a downwardly vertical main portion 68. The main portion 68 is formed with two horizontal grooves 70 and 72. The latch is manually movable vertically within its corresponding guide groove 46 between upper position (FIGS. 4 and 5) and a lower position as shown in FIG. 6. In the upper position of the latch as shown in FIGS. 4 and 5 the rib 50 enters into the groove 72 to hold the latch into position and allow for swinging operation of the door with the bottom of the latch withdrawn from the corresponding slot 48. With the door 64 in the closed position within the frame 62, the latch may be moved downwardly so as to locate the latch within the slot 48 as shown by FIG. 6 at which time the rib 50 enters the groove 70 to hold the latch in a locking position until otherwise manually returned into the upper position.

Figure 8:
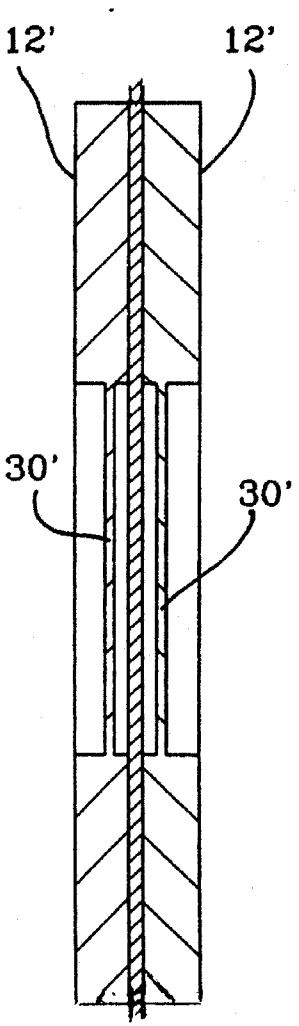
FIG. 8 is a cross-sectional detail view of a modified hinge arrangement.

In a modification of the first embodiment the webs 30 are located upon each molded part 12 so that, in the assembly, they are opposed to each other through the screen panel 60 from one part 12 to the other. With such an arrangement and with the webs 30 each having a side which is coplanar with the surfaces 34 and 36 of the associated molded part 12, when the two molded parts are fitted together, their respective webs 30 are separated only by the screen panel. In the modification as shown by FIG. 8 the webs 30' are spaced apart to reduce any tendency to bind as they flex. Thus, as shown in FIG. 8, webs 30' are recessed, by about one third of the thickness of the molded part 12', from the surface 34, 36 which, in use, will be juxtaposed to the other part 12'.

The embodiments of the invention in which an exclusive right or privilege is claimed are defined as follows:

1. A pet door kit for assembling to a screen panel and comprising:- a door frame having two identical frame sides and a door comprising two identical door sides, the frame sides for mounting in opposition one on each side of a mesh screen panel and the door sides for mounting in opposition one on each side of the screen panel within an aperture defined within the frame; each of said door sides having a first group of integrally-molded pins spaced apart around the door side and a first group of apertures correspondingly spaced apart, each of said frame sides having a second group of integrally-molded pins spaced apart around the frame side and a second group of correspondingly spaced apart apertures, said first group of pins of each door side and said second group of pins of each frame side for piercing and passing through the screen panel and engaging in the first group of apertures and the second group of apertures, respectively, of the other frame side and other door side, to secure the frame sides together and to secure the door sides together while sandwiching the screen panel between the sides of the frame and between the sides of the door; and in assembled condition of the kit, access being provided by a gap between the door and the frame to enable the screen panel spanning the gap to be severed around the door to permit the door to pivot within the frame.

2. A kit as claimed in claim 1, wherein the frame sides and the door sides have screen panel engaging surfaces for engaging the screen panel, all of the screen panel engaging surfaces being planar.

3. A kit as claimed in claim 1, wherein two identical integrally-molded parts are provided, each molded part comprising a frame side, a door side and an integral hinge portion by which the door side is pivotable upon the frame side, the hinge portion being offset to one side of a center line of the part such that, when the two parts are assembled to opposite sides of the screen panel, the hinge portion of one of the molded parts is offset from the hinge portion of the other of the molded parts along a corresponding edge of the door.

4. A pet door kit comprising:- a door frame having two frame sides: a door comprising two door sides, the frame sides for mounting in opposition one on each side of a mesh screen panel and the door sides for mounting in opposition one on each side of the screen panel and pivotable through an aperture defined within the frame; a first group of securing members and a second group of securing members for passing through the screen panel with the members of the first and second groups in spaced localized positions, respectively, around the door frame and around the door to secure the frame sides together and to secure the door sides together while sandwiching the screen panel between the sides of the frame and between the sides of the door; and in assembled condition of the kit, access being provided to enable the screen panel to be severed around the door to permit the door to pivot within the frame, the kit comprising two integrally molded parts wherein each integrally molded part comprises a frame side, an associated door side, and an integral hinge portion by which the door side is pivotable upon the frame side.

5. A kit as claimed in claim 4, wherein each molded part is provided with screen panel engaging surfaces which are solely planar and, with the door side in a closed condition within and surrounded by the associated frame side, the planar screen panel engaging surfaces are coplanar to enable the screen panel to be sandwiched between the frame sides and between the door sides of the molded parts while extending in planar condition, before being severed, between the door and the frame.

6. A kit as claimed in claim 5, wherein the two molded parts are identical in shape, each molded part integrally formed with securing members of each of the first and second groups and also formed with apertures for receiving securing members of each of the first and second groups which extend from the other molded part.

7. A kit as claimed in claim 4, wherein the integral hinge portion of each molded part is provided by spaced webs extending from the door side to the frame side of the molded part.

8. A kit as claimed in claim 7, wherein each web is thinner than the door and frame sides of the molded part.

9. A kit as claimed in claim 1, wherein the pins are a force fit within their corresponding apertures.

10. A kit as claimed in claim 6, wherein the securing members are a force fit within their corresponding apertures.

11. A kit as claimed in claim 1, provided with a latch movable into and out of a position to lock the door in a closed position within the frame after assembly of the kit.

12. A kit as claimed in claim 1, provided with magnetic means to hold the door normally in a closed position until a positive opening force is applied to the door.

13. A kit as claimed in claim 6, wherein the identical integral molded parts are each formed with slots in the door side and in the frame side, the slots being aligned in the closed position of the door side, and a latch is provided to move into and out of a locking position in both of the aligned slots of one of the molded parts to lock the door in a closed position within the frame after assembly of the kit and magnetic means is provided in the other slots for location in close relative proximity with the door closed so as to hold the door normally in a closed position until a positive opening force is applied to the door.

14. A method of assembling a pet door and frame onto a mesh screen panel comprising disposing two sides of a door frame in opposition one on each side of the screen panel and disposing two sides of a door each within and substantially filling an aperture defined within a respective surrounding one of the sides of the frame, the sides of the door being disposed in opposition one on each side of the screen panel extending across the aperture, securing together the opposed sides of said door frame and said door, respectively, with the screen panel sandwiched between them by passing through the screen panel in spaced localized positions, a first group of securing members to secure the frame sides together to form the frame and a second group of securing members to secure the door sides together to form the door, and then, through a gap provided between the door and the frame, severing the screen panel extending across the gap to permit the door to pivot within the frame.

15. A method as claimed in claim 14, comprising sandwiching the screen panel between planar opposing surfaces of the frame sides and of the door sides to locate the screen panel in a planar condition between the opposing sides of the door and the frame before severing the screen panel around the door.

16. A method as claimed in claim 15, wherein two integrally molded parts are provided, each molded part comprising a frame side, a door side, and an integral hinge portion by which the door side is pivotable upon the frame side, the method comprising severing the screen panel to provide a door hinge, the door hinge comprising opposed hinge portions of the assembled molded parts and a screen panel portion extending from the frame to the door and sandwiched between the hinged portions.

17. A method as claimed in claim 15, wherein two integrally-molded parts are provided, each molded part comprising a frame side, a door side and an integral hinge portion by which the door side is pivotable upon the frame side, the method further comprising the step of assembling the door sides and frame sides such that the hinge portion of one of the molded parts is offset from the hinge portion of the other of the molded parts along a corresponding edge of the door, and severing of the screen panel mesh to leave the door depending from the hinge portions only.

18. A pet door and mesh screen panel combination comprising a pet door having a frame comprising two identical frame sides and a door comprising two identical door sides, the frame sides mounted in opposition one on each side of the screen panel and each of the door sides mounted in an aperture in a respective of the frame sides, each of the door sides having a first group of integrally-molded pins spaced apart around the door side and a first group of correspondingly spaced apart apertures, each of said frame sides having a second group of integrally-molded pins spaced apart around the frame side and a second group of correspondingly spaced apart apertures, said first group of pins of each door side and said second group of pins of each frame side passing through the screen panel and engaging in the first group of apertures and the second group of apertures, respectively, of the other door side and other frame side thereby securing the frame sides together and door sides together with the screen panel sandwiched between them, the door being pivotable through the aperture and that portion of the screen panel sandwiched between the door sides being that formed by severing the screen around the door.

19. A pet door and screen panel combination as claimed in claim 18, the door and frame sides having screen panel engaging surfaces which engage the screen panel, all of the screen panel engaging surfaces being planar and being coplanar in a closed position of the door.

* * * * *